US005876839A

United States Patent [19]

Hung

[11] Patent Number: 5,876,839

[45] Date of Patent: Mar. 2, 1999

[54] TRANSFER PRINTING DYE-SHEET AND THE PREPARATION THEREOF

[76] Inventor: Chao-Yi Hung, No. 6, 12th Rd., Industrial Dist., Taichung, Taiwan

[21] Appl. No.: 806,087

[22] Filed: Feb. 25, 1997

[51] Int. Cl.[6] ..... B41M 5/00

[52] U.S. Cl. ..... 428/195; 428/913; 428/914

[58] Field of Search ..... 428/195, 913, 428/914; 503/227; 8/471

[56] References Cited

U.S. PATENT DOCUMENTS 5,646,089 7/1997 Oshima et al. ..... 503/227

*Primary Examiner*—Bruce H. Hess

*Attorney, Agent, or Firm*—Oppenheimer Wolff & Donnelly LLP

[57] ABSTRACT

A transfer printing dye-sheet for printing a dye of a pattern and/or an image thereon to a receiver sheet is disclosed. The transfer printing dye-sheet is composed of a substrate having on one surface thereof a pressure-sensitive film binder, a first layer of transparent oil coated onto the pressure-sensitive film binder, a layer dye of pattern and/or image which is ultraviolet light-curable being printed onto the first layer of transparent oil, a second layer of transparent oil coated onto the dye of pattern and/or image, and a transfer film covering the second layer of transparent oil. The process of preparing the transfer printing dye-sheet is also disclosed. The transfer printing dye-sheet can transferably print more beautiful and reliable patterns and/or images onto a receiver sheet in an economical manner.

2 Claims, 3 Drawing Sheets

TRANSFER PRINTING DYE-SHEET AND THE PREPARATION THEREOF

The present invention relates to a transfer printing dye-sheet for transfer printing patterns and/or images thereon to a receiver sheet and/or an article. The present invention also relates to a process of preparing the transfer printing dye-sheet.

BACKGROUND OF THE INVENTION

Transfer printing is a well-known printing process, especially in the field of printing on a non-flat article, in which a dye is transferred from a dye-sheet to a receiver sheet by stimuli (heat or/and pressure) to form a pattern and/or image on the receiver sheet. As in transfer printing, the dye sheet is intimately contacted with the receiver sheet, and the stimuli are applied to the dye sheet to cause the dye on the dye-sheet to transfer to the receiver sheet, and the dye sheet and receiver sheet are then separated.

Conventionally, the printing dye-sheet for transfer printing patterns and/or images thereon to a receiver sheet is formed by, referring to FIG. 5, a base L which comprises a transparent substrate 52, a first layer of binder 54 and a layer of transparent polyethylene terephthalate (PET) 56 being coated onto the binder 54; a dye 58 forming a pattern and/or an image which is printed onto the base L (i.e. onto the transparent polyethylene terephthalate (PET) 56), a layer of polypropylene resin 59, a second layer of binder 57, and a layer of releasing paper 60. According to the conventional printing-sheet, the dye 58 is enclosed between the layer of transparent polyethylene terephthalate (PET) 56 and the layer of polypropylene resin 59. The object of the layer of polypropylene resin 59 is to enhance the brightness of the dye 58.

The conventional transfer printing dye sheet is produced by the process of, referring to FIG. 4, 1) printing a dye 58 onto the base L, wherein the dye 58 is formed by 50 wt % of solid dye with 50 wt % of solvent, and the a solvent is xylene or cyclohexanone as is used in the conventional process. 2) cutting the layer of polyethylene terephthalate (PET) 56 and binder 54 along the outer boundary of the pattern and/or image on the polyethylene terephthalate (PET) 56 with a cutting instrument; 3) separating the portion of polyethylene terephthalate (PET) 56 and binder 54 which have been cut off; 4) brightening the dye 58 by covering it with a layer of polypropylene resin 59; 5) finishing: coating a second layer of binder 57 on the polypropylene resin 59, and covering a layer of releasing paper 60 onto the second layer of binder 57.

The time required to dry the dye 58 of step 1) is usually about 20–25 minutes, and the other steps require considerably longer time, thus, the conventional process is not suitable for mass production. In order to fit the profile of the pattern and/or image on the polyethylene terephthalate (PET) 56, the cutting instrument used in step 2) must be specifically designed and produced because of the irregularity of the pattern and/or image, thus, extra cost will be incurred. Additionally, also for the reason of the irregularity of the pattern and/or image, it is impossible to automatically separate the portion of polyethylene terephthalate (PET) 56 and binder 54 which have been cut off by the cutting instrument, that is, the step of separating must be completed manually.

As per the conventional printing dye-sheet 50 being used, the releasing paper 60 is firstly separated, then the dye-sheet 50 is located on and bounded to a proper position of a receiver sheet with the binder 57, then the substrate 52 is separated; thus, a pattern and/or image is printed onto the receiver sheet. However, as per the conventional dye-sheet 50 being bounded to the receiver sheet, the thickness of the polyethylene terephthalate (PET) 56 plus the-polypropylene resin 59 will make the surface of receiver sheet irregular, and this may result in contamination which will affect the integrated appearance of the receiver sheet.

SUMMARY OF THE INVENTION

The present invention relates to a transfer printing dye-sheet for transfer printing a pattern and/or an image thereon to a receiver sheet.

One object of the invention is to provide a transfer printing dye-sheet which can transferably print more beautiful and reliable pattern and/or image onto a receiver sheet.

Another object of the invention is to provide a process of preparing a transfer printing dye-sheet, which is economical, thus can reduce expenditure compared with conventional processes.

Yet another object of the invention is to provide a transfer printing dye-sheet which is composed of a substrate having on one surface thereof a pressure-sensitive film binder, a first layer of transparent oil coated onto said pressure-sensitive film binder, a layer of a pattern and/or an image which is ultraviolet light-curable being printed onto said first layer of transparent oil, a second layer of transparent oil coated onto said layer dye of pattern and/or image, and said second layer of transparent oil being covered with a transfer film.

DETAILED DESCRIPTION OF THE PREFERRED EMBODIMENTS

The present invention relates to a transfer printing dye-sheet for transfer printing pattern and/or image thereon to a receiver sheet. The present invention also relates to a process of preparing the transfer printing dye-sheet.

Figure 2:
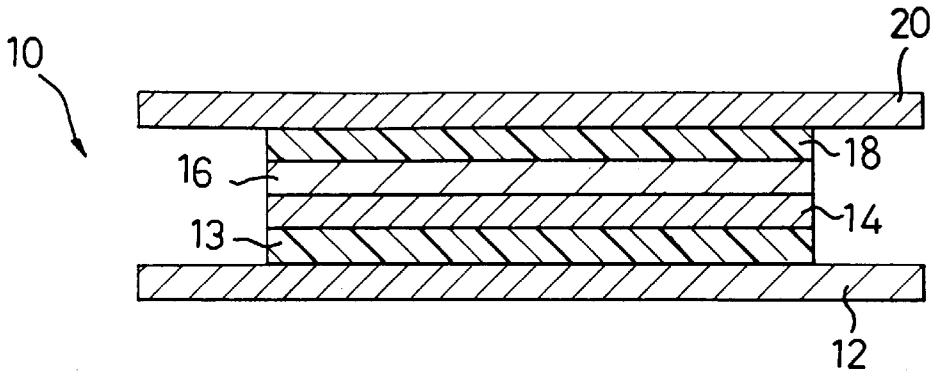
FIG. 2 is a cross-sectional view of the transfer printing dye-sheet according to the present invention.

Referring to FIG. 2, the inventive transfer printing dye-sheet 10 is composed of a substrate 12 having on one surface thereof a pressure-sensitive film binder 13, a first layer of transparent oil 14 coated onto said pressure-sensitive film binder 13, a dye forming a pattern and/or an image 16 which is ultraviolet light-curable being printed onto said first layer of transparent oil 14, a second layer of transparent oil 18 coated onto said layer dye of pattern and/or image 16, and said second layer of transparent oil 18 being covered by a transfer film 20.

The transparent oil 14 is the same as the transparent oil 18.

Figure 1:
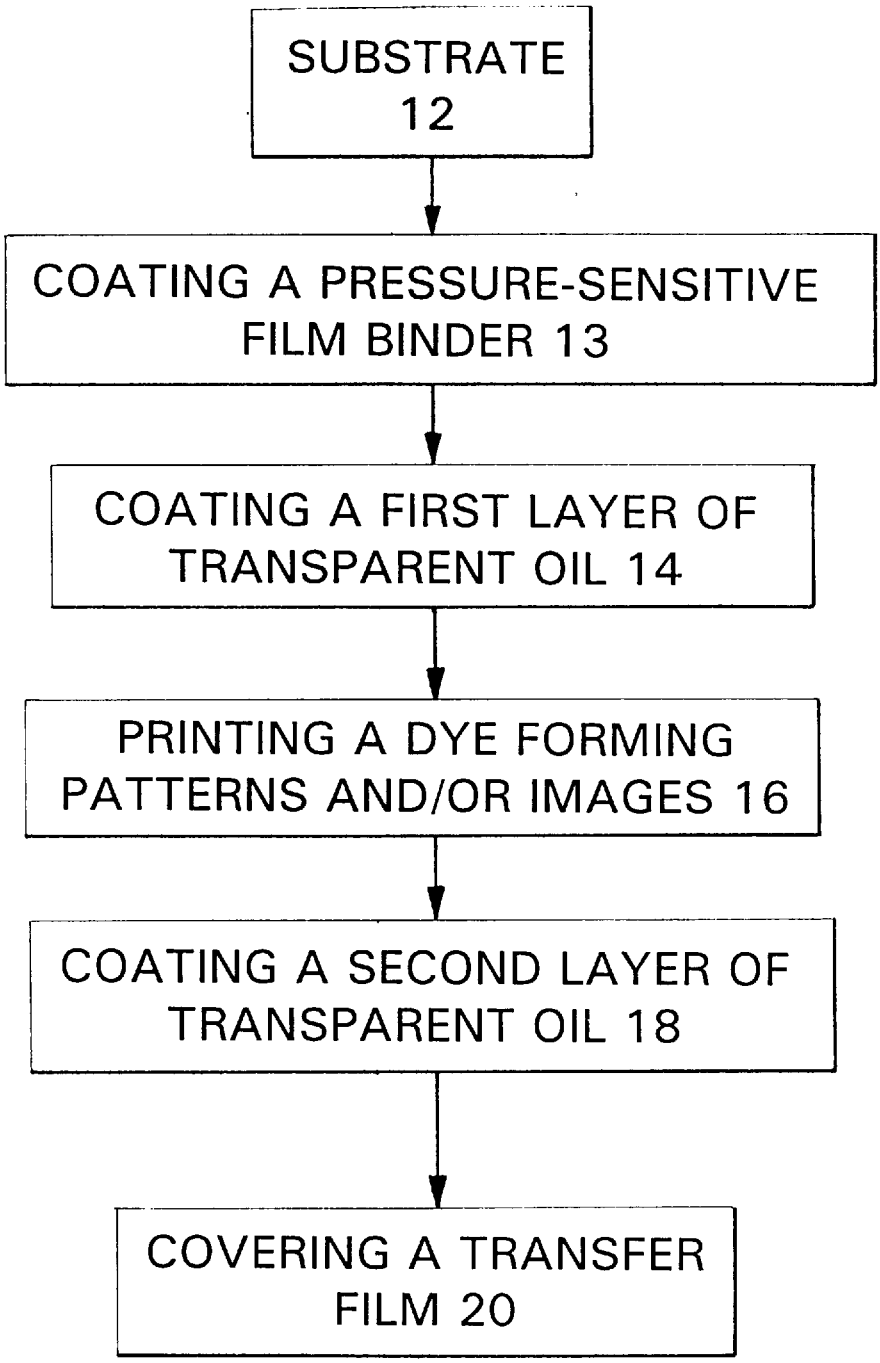
FIG. 1 is a flow chart of the process according to the present invention for preparing a transfer printing-dye sheet.

The present invention is also concerned with a process of 9 preparing the instant transfer printing-dye sheet 10, referring to FIG. 1, which comprises the steps of:

a) a substrate 12 being firstly coated with a pressure-sensitive film binder 13;

b) after said pressure-sensitive film binder 13 being dried, a first layer of transparent oil 14 being coated onto said press sure-sensitive film binder 13;

c) after said first layer of transparent oil 14 being dried, a dye forming patterns and/or images 16 which are ultraviolet light-curable being printed onto said first layer of transparent oil 14;

d) drying said dye of patterns and/or images 16 which are ultraviolet light-curable, then a second layer of transparent oil 18 being coated onto said layer dye of pattern and/or image 16; and e) after said second layer of transparent oil 18 being dried, said second layer of transparent oil 18 being covered by a transfer film 20.

All the materials used in the inventive process dry easily, thus, the drying procedures of steps b) to e) can be carried out with a conventional method, such as irradiating with ultraviolet source for 1 to 3 seconds.

Figure 3:
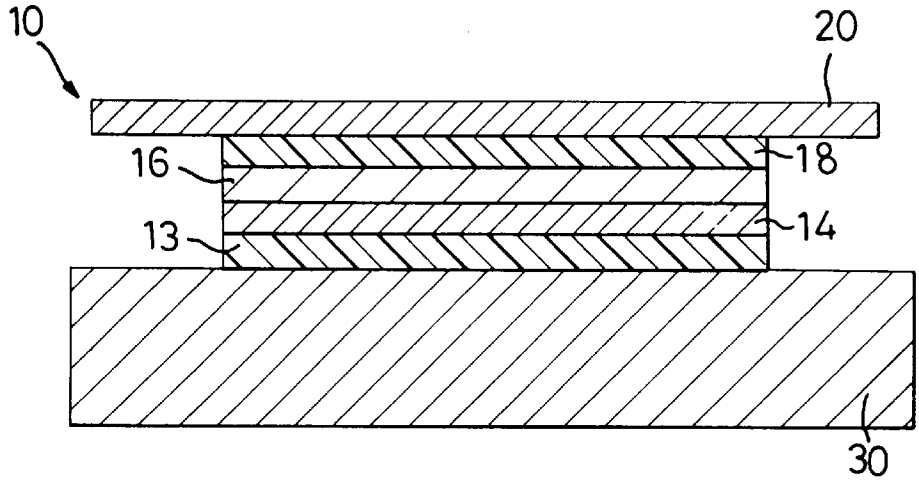
FIG. 3 is a cross-sectional view of the transfer printing dye-sheet according to the present invention printed on a receiver sheet.
Figure 5:
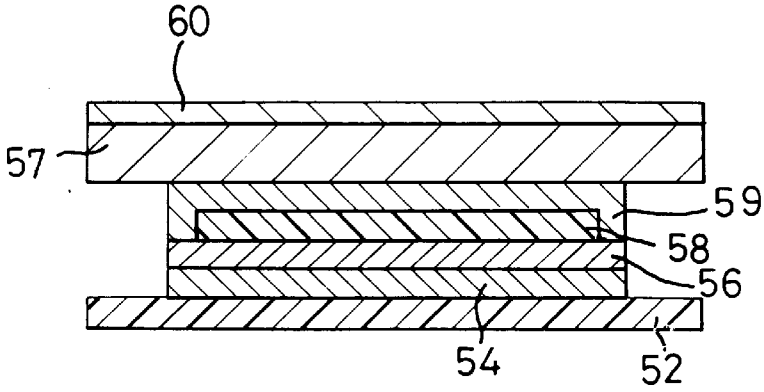
FIG. 5 PRIOR ART
FIG. 5 is a cross-sectional view of a conventional transfer printing dye-sheet.
Figure 4:
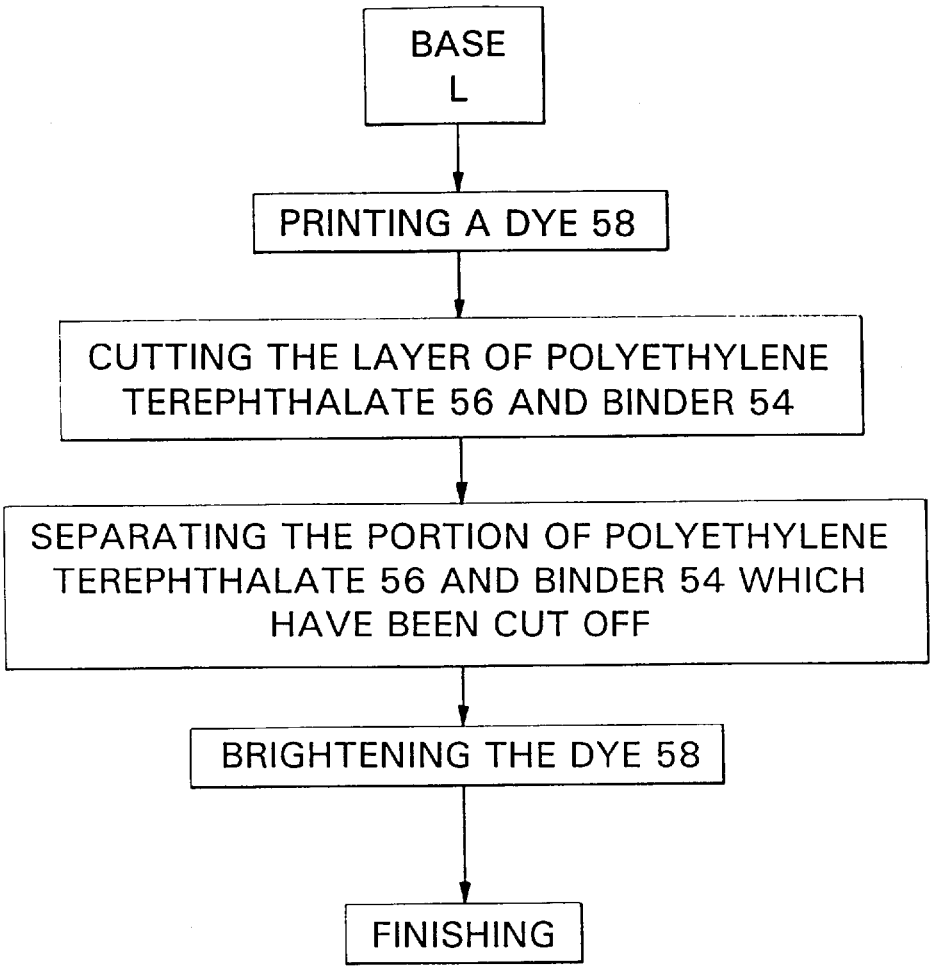
FIG. 4 is a flow chart of preparing a conventional transfer printing-dye sheet.

As per the transfer printing dye-sheet 10 being applied to a receiver sheet, referring to FIG. 3, the substrate 12 is firstly separated, then the dye-sheet 10 is positioned on a receiver sheet 30 via the pressure-sensitive film binder 13 binding the receiver sheet 30, and an adequate force is applied on the trans fer film 20. After the dye sheet lo is fixed on the receiver sheet 30, the transfer film 20 is separated.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed:

1. A transfer printing dye-sheet for transfer printing a dye of a pattern and/or an image thereon to a receiver sheet, which is characterized in that:

said dye-sheet is composed of a substrate having on one surface thereof a pressure-sensitive film binder, a first layer of transparent oil coated onto said pressure-sensitive film binder, a layer of a dye of a pattern and/or an image of ultraviolet light-curable printed onto said first layer of transparent oil, a second layer of transparent oil coated onto said layer dye of said pattern and/or said image, and a transfer film covered onto said second layer of transparent oil.

2. A transfer printing dye-sheet according to claim 1, wherein said substrate is a releasing paper.

* * * * *